US007779906B2

(12) United States Patent
Porter et al.

(10) Patent No.: US 7,779,906 B2
(45) Date of Patent: Aug. 24, 2010

(54) DOWNHOLE TOOL WITH MULTIPLE MATERIAL RETAINING RING

(75) Inventors: Jesse Porter, Duncan, OK (US); Joel Barlow, Oologah, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 208 days.

(21) Appl. No.: 12/217,840

(22) Filed: Jul. 9, 2008

(65) Prior Publication Data

US 2010/0006280 A1 Jan. 14, 2010

(51) Int. Cl.
*E21B 23/01* (2006.01)
*E21B 23/06* (2006.01)

(52) U.S. Cl. ..... 166/134

(58) Field of Classification Search ..... 166/134
See application file for complete search history.

(56) References Cited

U.S. PATENT DOCUMENTS

| | | | | |
|---|---|---|---|---|
| 5,224,540 | A | 7/1993 | Streich et al. | |
| 5,271,468 | A | 12/1993 | Streich et al. | |
| 5,540,279 | A | 7/1996 | Branch et al. | |
| 5,701,959 | A | 12/1997 | Hushbeck et al. | |
| 5,839,515 | A | 11/1998 | Yuan et al. | |
| 5,984,007 | A | 11/1999 | Yuan et al. | |
| 6,167,963 | B1 | 1/2001 | McMahan et al. | |
| 6,354,372 | B1 * | 3/2002 | Carisella et al. | 166/118 |
| 6,394,180 | B1 | 5/2002 | Berscheidt et al. | |
| 6,491,116 | B2 | 12/2002 | Berscheidt et al. | |
| 6,695,057 | B2 | 2/2004 | Ingram et al. | |
| 6,708,770 | B2 | 3/2004 | Slup et al. | |
| 7,048,066 | B2 | 5/2006 | Ringgenberg et al. | |

FOREIGN PATENT DOCUMENTS

| | | |
|---|---|---|
| EP | 0 798 445 A2 | 10/1997 |
| EP | 0 928 878 A2 | 7/1999 |
| EP | 1 116 860 A1 | 7/2001 |
| EP | 1 384 850 A2 | 1/2004 |

OTHER PUBLICATIONS

International Search Report dated Oct. 13, 2009, for PCT Application No. PCT/GB2009/001481.
U.S. Appl. No. 11/891,255, filed Aug. 9, 2007, James L. Barlow.
U.S. Appl. No. 11/893,445, filed Aug. 16, 2007, Robert Preston Clayton, et al.

* cited by examiner

*Primary Examiner*—Hoang Dang
(74) *Attorney, Agent, or Firm*—John W. Wustenberg; McAfee & Taft

(57) ABSTRACT

A downhole tool has a mandrel and an expandable packer element for sealingly engaging the well. A slip assembly is positioned on the mandrel and will anchor the downhole tool in the well. The slip assembly may include a slip ring that moves from an unset to a set position. A retaining ring is disposed about the slip ring and will hold the slip ring in the unset position until sufficient force is applied to break the retaining ring. The retaining ring may comprise a retaining band with a dampener to suppress the spring effect experienced by the retaining band when it breaks upon the application of force.

18 Claims, 2 Drawing Sheets

DOWNHOLE TOOL WITH MULTIPLE MATERIAL RETAINING RING

BACKGROUND

Downhole tools for use in oil and gas wellbores often have drillable components made from metallic or non-metallic materials, such as soft steel, cast iron, engineering grade plastics, and composite materials.

In the drilling or reworking of oil wells, a great variety of downhole tools are used. For example, but not by way of limitation, it is often desirable to seal tubing or other pipe in the casing of the well, such as when it is desired to pump cement or other slurry down the tubing and force the slurry out into a formation. It thus becomes necessary to seal the tubing with respect to the well casing and to prevent the fluid pressure of the slurry from lifting the tubing out of the well. Downhole tools referred to as packers and bridge plugs are designed for these general purposes and are well known in the art of producing oil and gas.

Bridge plugs isolate the portion of the well below the bridge plug from the portion thereabove. Bridge plugs therefore may experience a high differential pressure and must be capable of withstanding the pressure so that the bridge plug seals the well and does not move in the well after it has been set.

Bridge plugs make use of metallic or non-metallic slip segments, or slips, that are initially retained in close proximity to a mandrel but are forced outwardly away from the mandrel of the tool upon the tool being set to engage a casing previously installed within an open wellbore. Upon the tool being positioned at the desired depth, or position, the slips are forced outwardly against the inside of the casing to secure the packer, or bridge plug as the case may be, so that the tool will not move relative to the casing when, for example, operations are being conducted for tests, to stimulate production of the well, or to plug all or a portion of the well.

Cylindrically shaped inserts, or buttons, may be placed in such slip segments, especially when the slip segments are made of a non-metallic material such as plastic composite material, to enhance the ability of the slip segments to engage the well casing. The buttons must be of sufficient hardness to be able to partially penetrate, or bite into, the surface of the well casing which is typically steel. However, especially in the case of downhole tools being constructed of materials that lend themselves to being easily drilled from the wellbore once a given operation involving the tool has been performed, the buttons must not be so hard or so tough to resist drilling or fouling of the cutting surfaces of the drilling bit or milling bit.

A retaining ring is disposed about the slip segments, generally in a groove in the slip segments, to hold the slip segments in an unset position prior to the slip segments being forced outwardly into the casing. The retaining ring is intended to prevent the slip segments from moving outwardly prematurely. When the slip segments move radially outwardly, the retaining ring breaks, so that the slip segments can move outwardly to engage the casing to secure the tool in the well. The retaining rings often have a "spring effect" upon breaking which causes the broken retaining band to spring with enough energy to move away from the slip segments. The retaining ring may move or spring enough to wedge between the slip segments and the casing, or other part of the tool and the casing and can prevent the tool from setting, sealing or operating properly in the well. There is a need for a retaining ring that will apply sufficient holding force, but that will have a limited spring effect.

SUMMARY

A downhole tool has a mandrel and an expandable packer element disposed thereabout for sealingly engaging a well. Slip assemblies are positioned on the mandrel above and/or below the packer element to anchor the downhole tool in the well. Each slip assembly comprises a slip ring movable from an unset position to a set position in which the slip ring engages the well. The slip ring comprises a plurality of slip segments. Each slip segment is retained about the mandrel and is movable radially outwardly so that it will engage the well and anchor the tool in the well. A plurality of inserts, or buttons may be secured to the slip segments, and will extend outwardly from the outer surface thereof to grip casing in the well.

A retaining ring is disposed about the slip ring to retain the slip ring about the mandrel, and may be received in grooves defined in the slip segments that comprise the slip ring. The retaining ring will hold the slip ring in an unset position, and will prevent the slip ring from prematurely moving outwardly to the set position in which the slip ring grippingly engages the casing to hold the tool in the well.

The retaining ring comprises a retaining band with a dampener, which may be referred to as a spring suppressor, affixed thereto. The dampener will dampen, or suppress the spring effect that would occur if the retaining band were used without the dampener. The dampener may be comprised of rubber, and may be bonded or molded to the retaining band. The retaining band may be, for example, a fiberglass composite retaining band. The dampener may be affixed to an outer surface of the retaining band, and may completely encapsulate the retaining band.

DETAILED DESCRIPTION OF A PREFERRED EMBODIMENT

Figure 1:
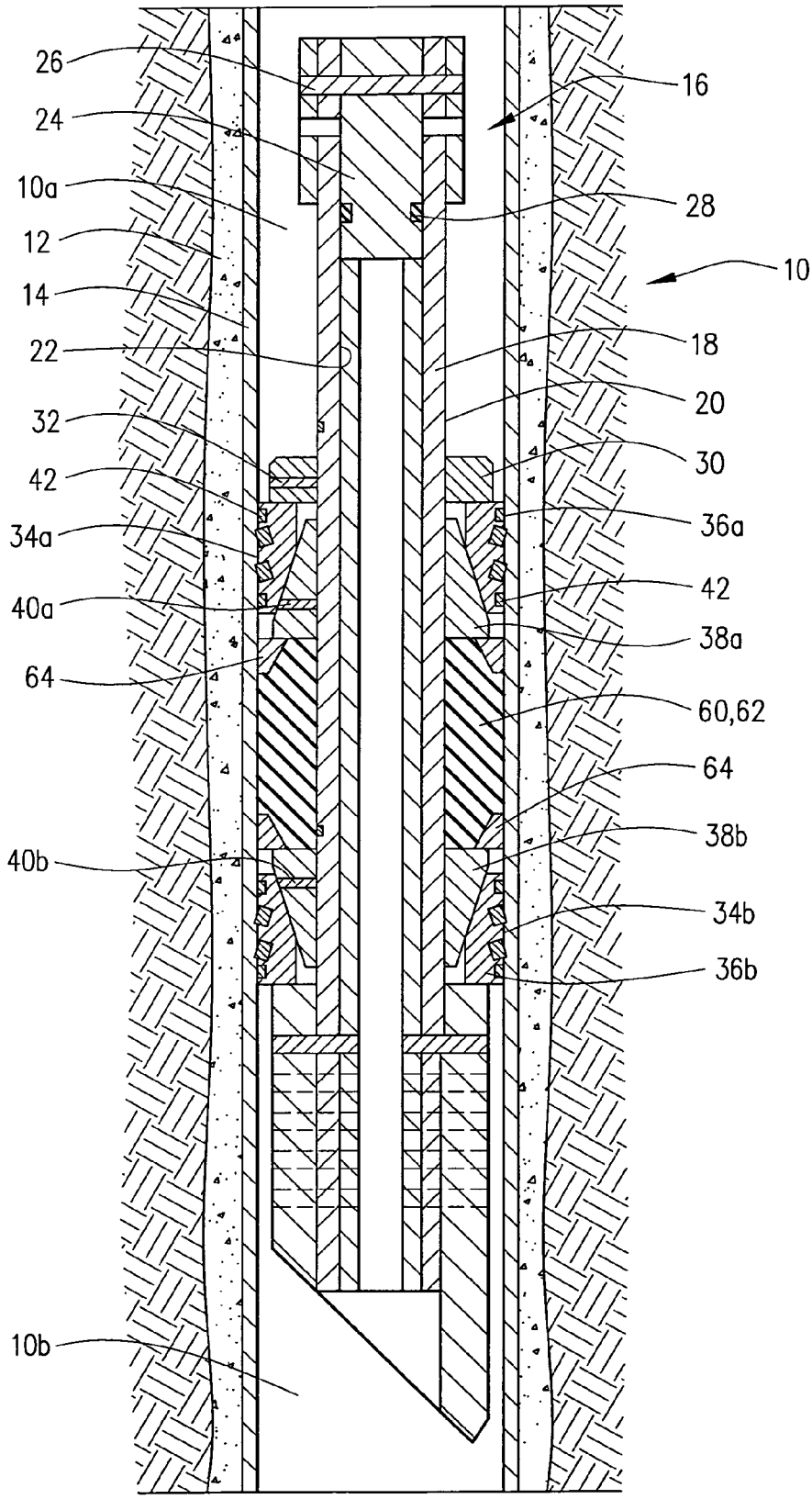
FIG. 1 is a cross section of a downhole tool disposed in a well.

Referring to the drawings, FIG. 1 shows well 10 comprising a wellbore 12 with a casing 14 cemented therein. Downhole tool 16 comprises a mandrel 18 with an outer surface 20 and an inner surface 22. The tool in FIG. 1 may generally be referred to as a bridge plug since downhole tool 16 has an optional plug 24 pinned within mandrel 18 by radially oriented pins 26. Plug 24 has a seal 28 located between plug 24 and mandrel 18. The overall tool structure would be suited for use as and referred to simply as a packer if plug 24 were not incorporated and fluid communication were allowed through the tool. Other components may be connected so that the packer, without plug 24 may be used, for example, as a frac plug.

A spacer ring 30 is mounted to mandrel 18 with a pin 32. A slip assembly 34 is disposed about mandrel 18 and spacer ring 30 provides an abutment which serves to axially retain slip assembly 34. Downhole tool 16 has two slip assemblies 34, namely a first slip assembly and second slip assembly which are shown in the drawings and are designated in the drawings as first and second slip assemblies 34*a* and 34*b* for ease of reference. The slip assemblies will anchor downhole tool 16 in well 10. The structure of slip assemblies 34*a* and 34*b* is identical, and only the orientation and position on downhole tool 16 are different. Each slip assembly 34 includes a slip ring 36 and slip wedge 38 which is pinned into place with pins 40.

Slip ring 36 is an expandable slip ring 36 which has a retaining ring 42 disposed in grooves 44. Retaining ring 42 will retain slip ring 36 in an unset position about mandrel 18 when downhole tool 16 is lowered into the well. Slip rings 36 may be moved or radially expanded from the unset to the set position which is seen in FIG. 1 in which the first and second slip rings 36 engage casing 14 to hold downhole tool 16 in the well. Retaining rings 42 will break as slip rings 36 expand radially outwardly, but must have sufficient strength to prevent premature breakage. A large load, for example, 1200 pounds of force applied axially may be necessary to generate enough radial force to break retaining rings 42 when slip rings 36 are moved to the unset position.

Slip rings 36 are comprised of a drillable material and may be, for example, a molded phenolic and have an outer surface 46. Slip rings 36 may be made from other drillable materials as well such as drillable metals, composites and engineering grade plastics. The remainder of the slip assembly and other components of the tool may likewise be made from drillable materials. A plurality of inserts or buttons 48 are secured to slip ring 36 by adhesive or by other means and extend radially outwardly from outer surface 46. The buttons are comprised of material of sufficient hardness to partially penetrate or bite into the well casing and may be comprised, for example, of tungsten carbide or other materials. The buttons may be, for example, like those described in U.S. Pat. No. 5,984,007. In the set position as shown in FIG. 1, buttons 48 will engage or grip casing 14 to hold tool 16 in place.

Figure 2:
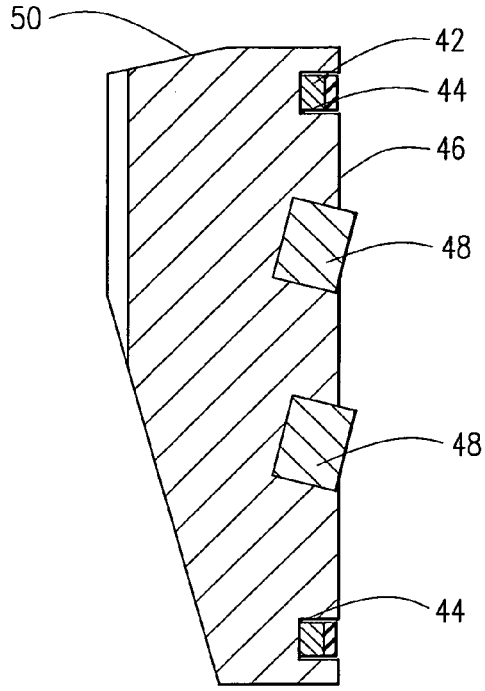
FIG. 2 is an enlarged cross-sectional side view of a slip segment with a retaining band disposed in grooves in the slip segment.
Figure 3:
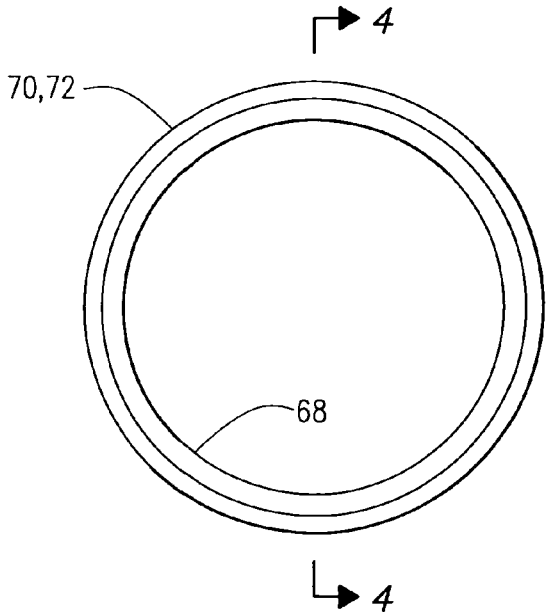
FIG. 3 is a top view of a retaining ring.
Figure 4:
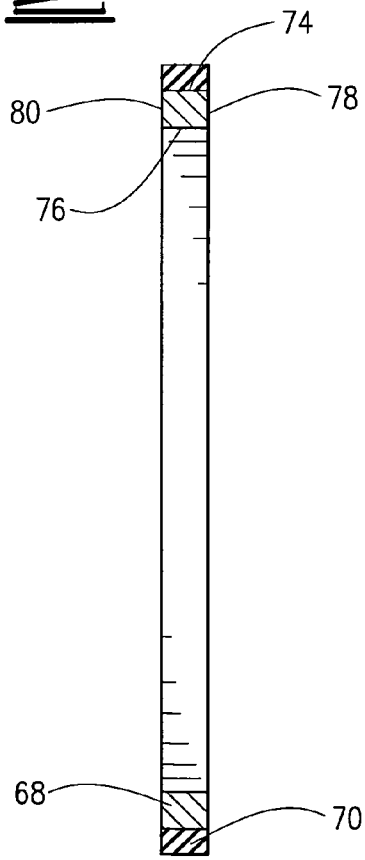
FIG. 4 is a cross-sectional view taken from line 4-4 of FIG. 3.

Each slip ring 36 is preferably comprised of a plurality of slip segments 50. Slip segments 50 are shown in cross section in FIG. 2. Slip rings 36 may include, for example, six to eight slip segments 50 that encircle mandrel 18. Slip ring 36 may include more or less than six or eight segments, and the examples herein are non-limiting. A packer element assembly 60 which includes at least one expandable packer element 62 is positioned between slip wedges 38. Packer shoes 64 may provide axial support to the ends of packer element assembly 60.

Retaining rings 42 are disposed about slip rings 36, and may be received in grooves 44. Retaining rings 42 are each comprised of a retaining band 68, and a dampener, or spring suppressor 70. Retaining band 68 may be made from a metal, or may be a composite, such as a fiberglass composite retaining band. The examples provided are not limiting, and retaining band 68 may comprise any material, preferably a drillable material, that will provide adequate strength to prevent premature breakage. Dampener 70 may be made from rubber, for example, a nitrile rubber. Other materials that will dampen or suppress the energy, or spring effect of retaining band 68 may be used. Dampener 70 is affixed to retaining band 68 by, for example, bonding, or molding.

Retaining band 68 may be a ring-shaped band 68, and may have a rectangular cross section with outer surface 72. Outer surface 72 may comprise outer circumferential surface 74, inner circumferential surface 76, and side surfaces 78 and 80. Dampener 70 may be affixed to any or all of surfaces 74, 76, 78 and 80, and may, if desired, completely encapsulate retaining band 68.

In operation, downhole tool 16 is deployed in well 10 using known deployment means such as for example jointed or coiled tubing. Downhole tool 16 will be in an unset position wherein tool 16 does not engage well 10. Thus, neither slip ring 36, nor packer element assembly 60 will engage casing 14 in the unset position. In the unset position, spacer ring 30, both of slip rings 36*a* and 36*b* and slip wedges 38*a* and 38*b* are all in an initial position about mandrel 18 and are positioned radially inwardly from the set position shown in FIG. 1. When downhole tool 16 reaches a desired location in the well, each of slip rings 36*a* and 36*b* are moved radially outwardly to the set position shown in FIG. 1, and tool 16 may be left in well 10. Downhole tool 16 separates well 10 into upper well portion 10*a* and lower portion 10*b*. The upper and lower portions 10*a* and 10*b* are isolated from one another by well tool 16 which in the embodiment shown is a bridge plug.

Retaining rings 42 will retain slip rings 36 in place about mandrel 18 in the unset position prior to being moved to the set position in FIG. 1. Retaining rings 42 will break as slip rings 36*a* and 36*b* move radially outwardly to the set position. If the retaining rings break prematurely, the slip rings 36 may move outwardly and can cause the tool to hang up in the well. Increasing the strength of the retaining rings may prevent premature breakage, but will also increase the energy released and the spring effect upon breakage. The retaining ring 42 disclosed herein may be designed to require as much as 3000 pounds or more applied axially to generate the outward radial force necessary to break retaining ring 42. Retaining rings 42 will stay in groove 44, since the dampener 70 reduces the spring effect experienced by retaining rings 42 designed to break at high load levels. Dampener 70 prevents retaining ring 42 from moving out of groove 44 and becoming trapped between slip ring 36, or other tool component, and well 10. Retaining rings 42 have been shown to require as much as 4500 pounds of applied axial force to break, and the spring effect reduced sufficiently to prevent retaining rings 42 from moving out of grooves 44.

The significant amount of energy released when retaining rings 42 break, in the absence of dampener 70 could cause the retaining rings 42 to move away from slip rings 36, and prevent proper engagement of the slip rings by setting between slip rings 36 and the casing 14. Dampeners 70 dampen, or suppress the spring effect, so that when retaining rings 42 break, they will stay in grooves 44.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A downhole tool for use in a well comprising:

a mandrel;

a slip ring disposed about the mandrel and movable from an unset position to a set position, wherein in the set position the slip ring grippingly engages the well; and a retaining ring for holding the slip ring in the unset position, the retaining ring comprising a retaining band and a dampener affixed to the retaining band, wherein the dampener adheres to the outer surface of the retaining band and wherein the retaining band is comprised of a first material and the dampener is comprised of a second material.

2. The downhole tool of claim 1, wherein the first material is a fiberglass composite and the second material is rubber.

3. The downhole tool of claim 1, wherein the dampener completely encapsulates the retaining band.

4. The downhole tool of claim 1, wherein the dampener circumscribes the retaining band.

5. The downhole tool of claim 1, further comprising first and second slip rings and at least one packer element disposed about the mandrel, wherein one of the retaining rings holds each of the first and second slip rings in the unset position, and wherein the retaining bands break upon the application of outward radial force applied when the slip rings move from the unset to the set position.

6. The downhole tool of claim 5, wherein the retaining bands are a fiberglass composite.

7. A downhole tool for use in a well comprising:

a mandrel;

an expandable packer disposed about the mandrel;

a first slip ring disposed about the mandrel and movable from an unset to a set position to grippingly engage the casing, the first slip ring being located above the packer element;

a first retaining ring positioned in a groove in the first slip ring;

a second slip ring disposed about the mandrel and movable from an unset to a set position to grippingly engage the casing, the second slip ring being located below the packer; and a second retaining ring positioned in a groove in the second slip ring, wherein the first and second retaining rings each comprise a retaining band with a spring suppressor affixed thereto to limit the spring effect that occurs when the first and second retaining bands break due to the movement of the slip rings from the unset to the set position and wherein the spring suppressor encapsulates the retaining band.

8. The downhole tool of claim 7, wherein the spring suppressors are comprised of a nitrile rubber, and wherein the retaining bands are comprised of a composite.

9. The downhole tool of claim 7, wherein the first and second slip rings each comprise a plurality of slip segments with a groove therein for receiving first and second retaining rings.

10. A downhole tool for use in a well comprising:

a slip ring disposed about a mandrel of the tool, the slip ring movable from an unset to a set position in which the slip ring grippingly engages a casing in the well;

a retaining band disposed about the slip ring for preventing the slip ring from prematurely expanding radially outwardly to the set position; and a spring suppressor affixed to the retaining band to reduce the spring effect of the retaining band when it breaks due to the slip ring moving radially outwardly to the set position, wherein the spring suppressor adheres to the outer surface of the retaining band.

11. The downhole tool of claim 10, wherein the spring suppressor is molded to the retaining band.

12. The downhole tool of claim 10, wherein the spring suppressor is rubber.

13. The downhole tool of claim 10, wherein the spring suppressor encapsulates the retaining band.

14. The downhole tool of claim 10, wherein the slip ring comprises a plurality of slip segments, each with a groove therein, the retaining band with the spring suppressor affixed being received in the groove of each slip segment.

15. The downhole tool of claim 10 comprising:

first and second slip rings disposed about the mandrel; and an expandable packer element disposed about the mandrel and positioned between the first and second slip rings, each of the first and second slip rings having a retaining band disposed thereabout, each retaining band having a spring suppressor that adheres thereto.

16. The downhole tool of claim 15, wherein the spring suppressor is a rubber spring suppressor bonded to the retaining band.

17. The downhole tool of claim 15, the spring suppressor comprising a rubber spring suppressor molded to the retaining band.

18. The downhole tool of claim 15, the first and second slip rings each comprising a plurality of slip segments with a groove therein for receiving the retaining bands.

* * * * *